US007743749B1

(12) United States Patent
Suchecki et al.

(10) Patent No.: US 7,743,749 B1
(45) Date of Patent: Jun. 29, 2010

(54) FUEL PUMP DRIVE SYSTEM

(75) Inventors: Tom Suchecki, Sterling Heights, MI (US); David E. Masser, Dearborn Heights, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 12/506,558

(22) Filed: Jul. 21, 2009

(51) Int. Cl.
*F02M 37/04* (2006.01)
*F01L 1/34* (2006.01)

(52) U.S. Cl. ..... 123/495; 123/90.17; 123/508; 123/509

(58) Field of Classification Search ..... 123/90.15, 123/90.17, 495, 508, 509
See application file for complete search history.

(56) References Cited

U.S. PATENT DOCUMENTS

| | | | | |
|---|---|---|---|---|
| 1,824,536 | A | 9/1931 | Cutler | |
| 2,447,277 | A | 8/1948 | Rakos | |
| 2,822,792 | A | 2/1958 | Peterson | |
| 3,042,015 | A | 7/1962 | Peterson | |
| 5,899,181 | A * | 5/1999 | Kurata et al. | 123/90.17 |
| 6,125,819 | A | 10/2000 | Strieber et al. | |
| 6,170,471 | B1 * | 1/2001 | Yonezawa et al. | 123/508 |
| 6,352,060 | B1 | 3/2002 | Bentley | |
| 6,763,795 | B2 | 7/2004 | Takahashi | |
| 2009/0095263 | A1 * | 4/2009 | Uuzzie et al. | 123/495 |

* cited by examiner

*Primary Examiner*—Stephen K Cronin
*Assistant Examiner*—J. Page Hufty
(74) *Attorney, Agent, or Firm*—Julia Voutyras; Alleman Hall McCoy Russell & Tuttle LLP

(57) ABSTRACT

A fuel pump drive system is provided. A system for an engine driven by an engine crankshaft may include a first variable cam device including a first hydraulic actuator, and a second variable cam device including a second hydraulic actuator. The system may further include an intermediate power transfer mechanism coupled between the first variable cam device and the second variable cam device upstream, in a direction of power flow from the engine crankshaft, of the first hydraulic actuator and the second hydraulic actuator. The system may further include an auxiliary device coupled to and driven by the intermediate power transfer mechanism. In this way, because the auxiliary device is driven via the intermediate power transfer mechanism and thus derives its power from upstream of the hydraulic actuator of the variable cam device, the actuator can be adjusted without having to overcome resistance torque of the auxiliary device.

21 Claims, 7 Drawing Sheets

FUEL PUMP DRIVE SYSTEM

TECHNICAL FIELD

The present application relates to a fuel pump drive system coupled with variable cam timing actuators.

BACKGROUND AND SUMMARY

Engines with direct fuel injection may use high pressure fuel pumps to provide sufficient fuel pressure to the injectors. In some examples, the high pressure fuel pump may be driven by a cam lobe on the engine camshaft. In some cases, such a fuel pump drive lobe may be integrated into the camshaft where the valve timing is being actively phased during engine operation.

The inventors of the present application have recognized a problem in such previous approaches in that the fuel pump is typically driven "downstream" (in terms of power flow) of hydraulic actuators used to actively adjust timing of the intake and exhaust cams. For example, in previous approaches, the fuel pump may be driven at a camshaft side of a variable cam timing (VCT) actuator, whereas the VCT actuator is driven at the crankshaft side of the actuator by the crankshaft, e.g., via a timing chain. In such situations, when adjusting the phasing of the VCT actuator, the actuator may have to work against significant resistance by the fuel pump. Therefore, actuating a high pressure fuel pump in such a manner may adversely affect transient control of the valve timing, for example, by significantly decreasing the shifting velocity of the VCT actuator. If the shift velocity becomes too low, the performance, emissions and fuel economy of the engine may be degraded.

In one example, some of the above issues may be addressed by a system for an engine driven by an engine crankshaft. Such a system may include a first variable cam device including a first hydraulic actuator, and a second variable cam device including a second hydraulic actuator. The system may further include an intermediate power transfer mechanism, such as a gear or drive shaft, coupled between the first variable cam device and the second variable cam device upstream, in a direction of power flow from the engine crankshaft, of the first hydraulic actuator and the second hydraulic actuator. The system may further include an auxiliary device, such as a fuel pump, coupled to and driven by the intermediate power transfer mechanism.

In this way, the resistance torque of the fuel pump actuation may be located upstream of the first and second hydraulic actuators (e.g., at a sprocket side of the VCT actuators). As such, adjustment of the variable camshafts, for example variable cam timing, may be more accurately provided since adjustments to the camshaft are not required to overcome the fuel pump resistance torque.

Further, the fuel pump drive system may serve as a secondary timing drive coupling the housings of the first and second VCT devices, as well as the drive for the fuel pump. In the example of the drive shaft, it may rotationally couple a first and second camshaft in an overhead camshaft configuration, and thus a timing chain or belt between the two camshafts can be eliminated. Moreover, the claimed configuration can be packaged to fit between the intake and exhaust camshafts, where given the physical constraints of the configuration, a chain may not be suitable.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Embodiments of a fuel pump drive system actuated upstream (in terms of power flow) of hydraulic actuators of a variable cam timing system, and methods of operating such a fuel pump drive system, are disclosed herein. Such a fuel pump system may be utilized with an engine, as described hereafter.

Figure 1:
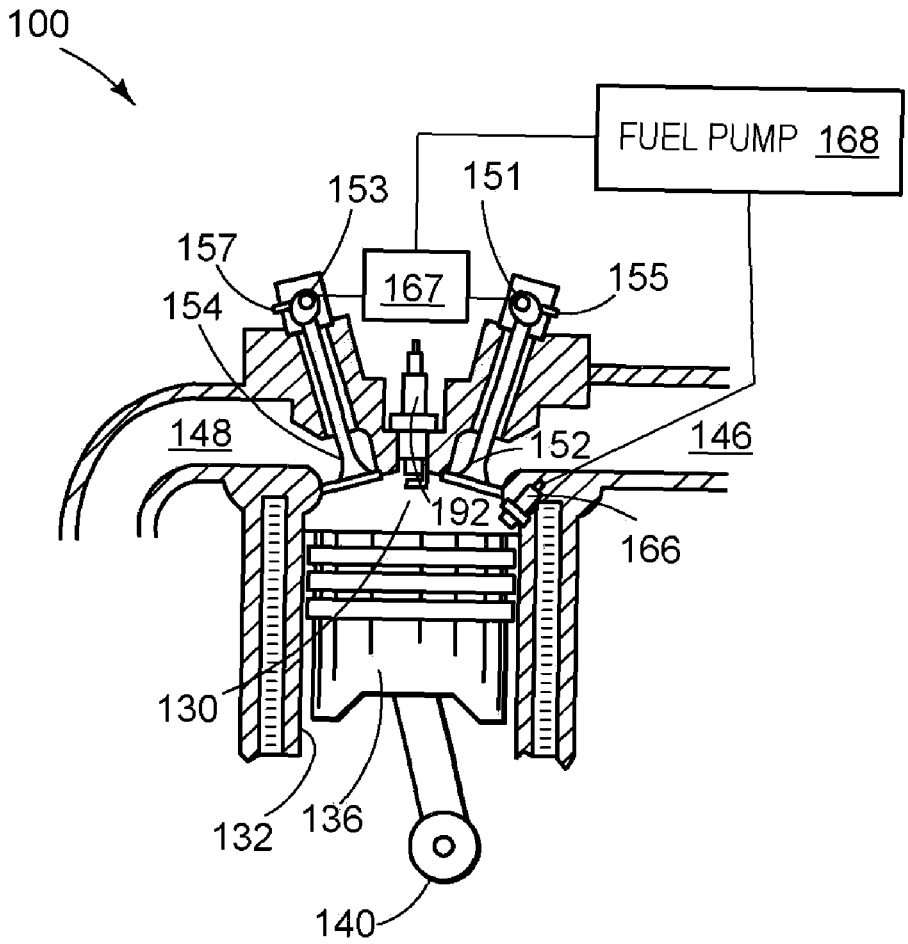
FIG. 1 shows an example engine in accordance with an embodiment of the present disclosure.

FIG. 1 is a schematic diagram showing one cylinder of multi-cylinder engine 100, which may be included in a propulsion system of an automobile. Engine 100 may be controlled at least partially by a control system (not shown) and by input from a vehicle operator via an input device. Such an input device may include an accelerator pedal and a pedal position sensor for generating a proportional pedal position signal. Combustion chamber (i.e. cylinder) 130 of engine 100 may include combustion chamber walls 132 with piston 136 positioned therein. Piston 136 may be coupled to crankshaft 140 so that reciprocating motion of the piston is translated into rotational motion of the crankshaft. Crankshaft 140 may be coupled to at least one drive wheel of a vehicle via an intermediate transmission system. Further, a starter motor may be coupled to crankshaft 140 via a flywheel to enable a starting operation of engine 100.

Combustion chamber 130 may receive intake air from intake manifold 146 via an intake passage and may exhaust combustion gases via exhaust passage 148. Intake manifold 146 and exhaust passage 148 can selectively communicate with combustion chamber 130 via respective intake valve 152 and exhaust valve 154. In some embodiments, combustion chamber 130 may include one or more intake valves and one or more exhaust valves.

In this example, intake valve 152 and exhaust valve 154 may be controlled by cam actuation via respective cam actuation systems 151 and 153. As shown in this example, cam actuation systems 151 and 153 correspond to camshafts that actuate a plurality of valves in a plurality of cylinders. Further, the cams may actuate valves of cylinders in a common bank. Cam actuation systems 151 and 153 may each include one or more cams and may utilize one or more of cam profile switching (CPS), variable cam timing (VCT), variable valve timing (VVT) and/or variable valve lift (VVL) systems that may be operated by the controller to vary valve operation. The position of intake valve 152 and exhaust valve 154 may be determined by position sensors 155 and 157, respectively.

Fuel injector 166 is shown coupled directly to combustion chamber 130 for injecting fuel directly therein in proportion to the pulse width of signal FPW received from the controller via an electronic driver. In this manner, fuel injector 166 provides what is known as direct injection of fuel into combustion chamber 130. The fuel injector may be mounted in the side of the combustion chamber or in the top of the combustion chamber, for example. Fuel may be delivered to fuel injector 166 by a fuel system including a fuel tank (not shown), a fuel pump 168, and a fuel rail (not shown). In some embodiments, combustion chamber 130 may alternatively or additionally include a fuel injector arranged in intake manifold 146 in a configuration that provides what is known as port injection of fuel into the intake port upstream of combustion chamber 130.

An ignition system can provide an ignition spark to combustion chamber 130 via spark plug 192 in response to spark advance signal from the controller, under select operating modes. Though spark ignition components are shown, in some embodiments, combustion chamber 130 or one or more other combustion chambers of engine 100 may be operated in a compression ignition mode, with or without an ignition spark.

Engine 100 further includes a fuel pump drive system 167 actuated by cam actuation systems 151 and 153. As an example, in the case of variable cam timing, each of the cam actuation systems 151 and 153 may include an input component (e.g., a housing) which receives and transfers power via a hydraulic fluid to an output component (e.g., a hydraulic actuator). Accordingly, the housing is rotatable with respect to the hydraulic actuator. Fuel pump drive system 167 is actuated upstream (in a direction of power flow from the engine crankshaft) of the output components of each of the cam actuation systems 151 and 153. Thus, the shifting velocity of the output components is not affected by actuation of the fuel pump drive system. Embodiments of a fuel pump drive system are described in more detail as follows.

Figure 2:
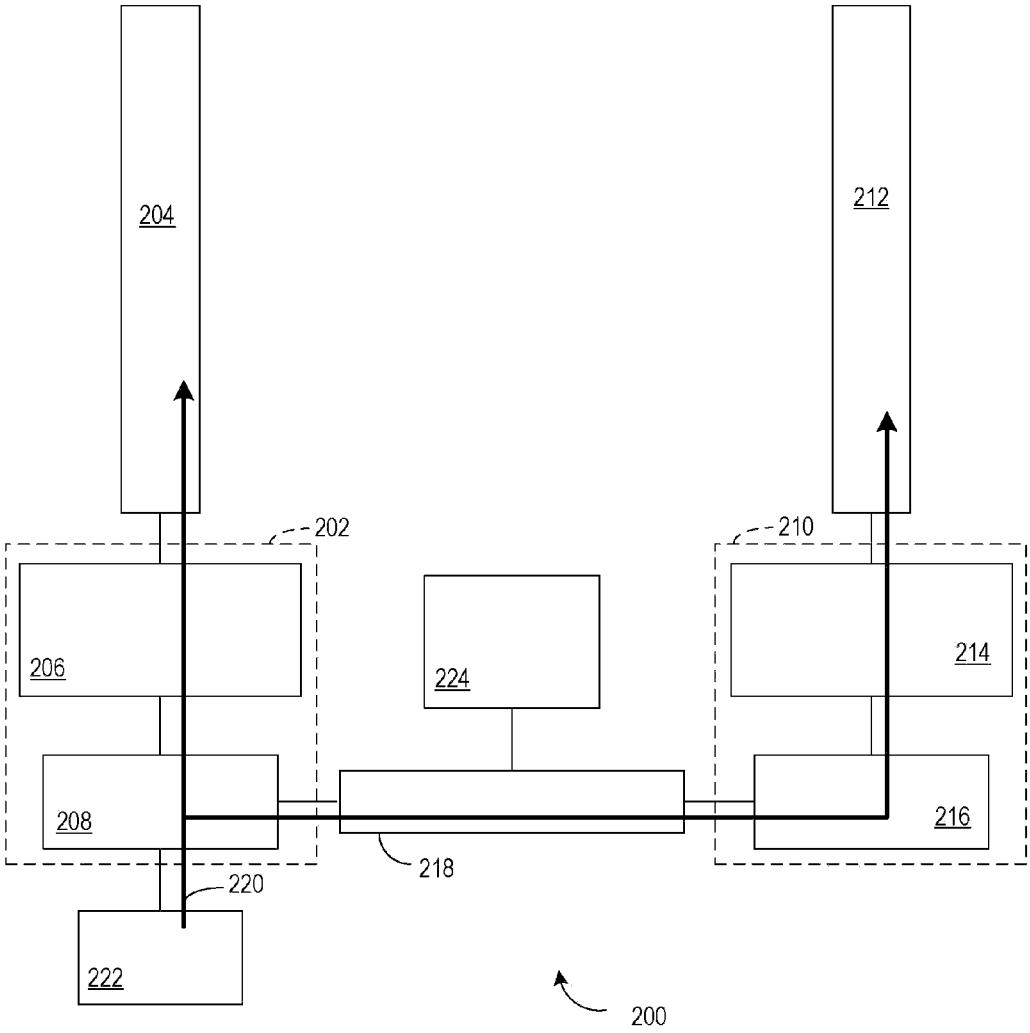
FIG. 2 shows a block diagram of an embodiment of a fuel pump drive system.

FIG. 2 shows an embodiment of a fuel pump drive system 200, which may constitute drive system 167 of engine 100. Thus, fuel pump drive system 200 may be for an engine driven by an engine crankshaft, such as a dual overhead cam engine. Fuel pump drive system 200 may include a first variable cam device 202 coupled to a first camshaft 204. First variable cam device 202 may include a first hydraulic actuator 206. First variable cam device 202 may further include a first housing 208 that is rotatable relative to first hydraulic actuator 206 via hydraulic fluid. Likewise, fuel pump drive system 200 may further include a second variable cam device 210 coupled to a second camshaft 212. Second variable cam device 210 may include a second hydraulic actuator 214, and a second housing 216 that is rotatable relative to second hydraulic actuator 214 via hydraulic fluid. In some embodiments, first variable cam device 202 and/or second variable cam device 210 may be variable cam timing devices.

First camshaft 204 and second camshaft 212 may be of any suitable configuration. One suitable configuration includes first camshaft 204 being sufficiently parallel to second camshaft 212. Further, first camshaft 204 and second camshaft 212 may be of a same bank. In some embodiments, first camshaft 204 may be an exhaust camshaft and second camshaft 212 may be an intake camshaft. Alternatively, in other embodiments, first camshaft 204 may be an intake camshaft and second camshaft 212 may be an exhaust camshaft.

Fuel pump drive system 200 may further include an intermediate power transfer mechanism, such as drive shaft 218 coupled between first variable cam device 202 and second variable cam device 210, upstream of the first hydraulic actuator 206 and the second hydraulic actuator 214. Such coupling can be done in any suitable manner, for example, via bevel gears, and is described in more detail with reference to FIG. 4. It can be appreciated that "upstream" is in terms of power flow of a drive component, for example, upstream in a direction of power flow from the engine crankshaft. Thus, whereas cam lobes configured to actuate the cylinder valves may be downstream of the first hydraulic actuator 206 and the second hydraulic actuator 214, drive shaft 218 is upstream of the first hydraulic actuator 206 and the second hydraulic actuator 214.

For example, FIG. 2 shows an example power flow 220, wherein the power flow is initiated at a crank 222 coupled to the first housing 208. As an example, first housing 208 may be driven by a primary timing chain via a chain sprocket. Power is transferred from first housing 208 to the first camshaft 204 via the first hydraulic actuator 206. As such, power may also be transferred from first housing 208 to second housing 216 via drive shaft 218. Accordingly, second housing 216 may then transfer power to second camshaft 212 via second hydraulic actuator 214. As such, fuel pump drive system 200 may serve as a secondary timing drive coupling first variable cam device 202 and second variable cam device 210.

In such an embodiment, by coupling drive shaft 218 between first housing 208 and second housing 216, the drive shaft is upstream of first hydraulic actuator 206 and second hydraulic actuator 214. In other words, a first end of drive shaft 218 may be coupled to first housing 208 upstream of first hydraulic actuator 206, and a second end of drive shaft 218 may be coupled to second housing 216 upstream of the second hydraulic actuator 214.

Further, drive shaft 218 may be positioned perpendicular to first camshaft 204 and second camshaft 212. For example, drive shaft 218 may be positioned between first housing 208 and second housing 216 at a right angle with respect to the first camshaft and the second camshaft.

Continuing with FIG. 2, fuel pump drive system 200 may further include a fuel pump 224, coupled to and driven by drive shaft 218. For example, drive shaft 218 may further include a fuel pump drive lobe to actuate fuel pump 224. By actuating fuel pump 224 via drive shaft 218, fuel pump 224 is actuated upstream of first hydraulic actuator 206 and second hydraulic actuator 214. As such, the resistance torque is moved upstream of first hydraulic actuator 206 and second hydraulic actuator 214 (i.e., at a sprocket side of the VCT actuators), such that a shifting velocity of first hydraulic actuator 206 may not be affected. In some embodiments, the fuel pump may be further coupled to a direct injector of a cylinder of the engine.

While FIG. 2 shows a fuel pump drive system, various alternative auxiliary devices may be driven via the arrangement of FIG. 2, such as hydraulic pumps, etc.

Figure 3:
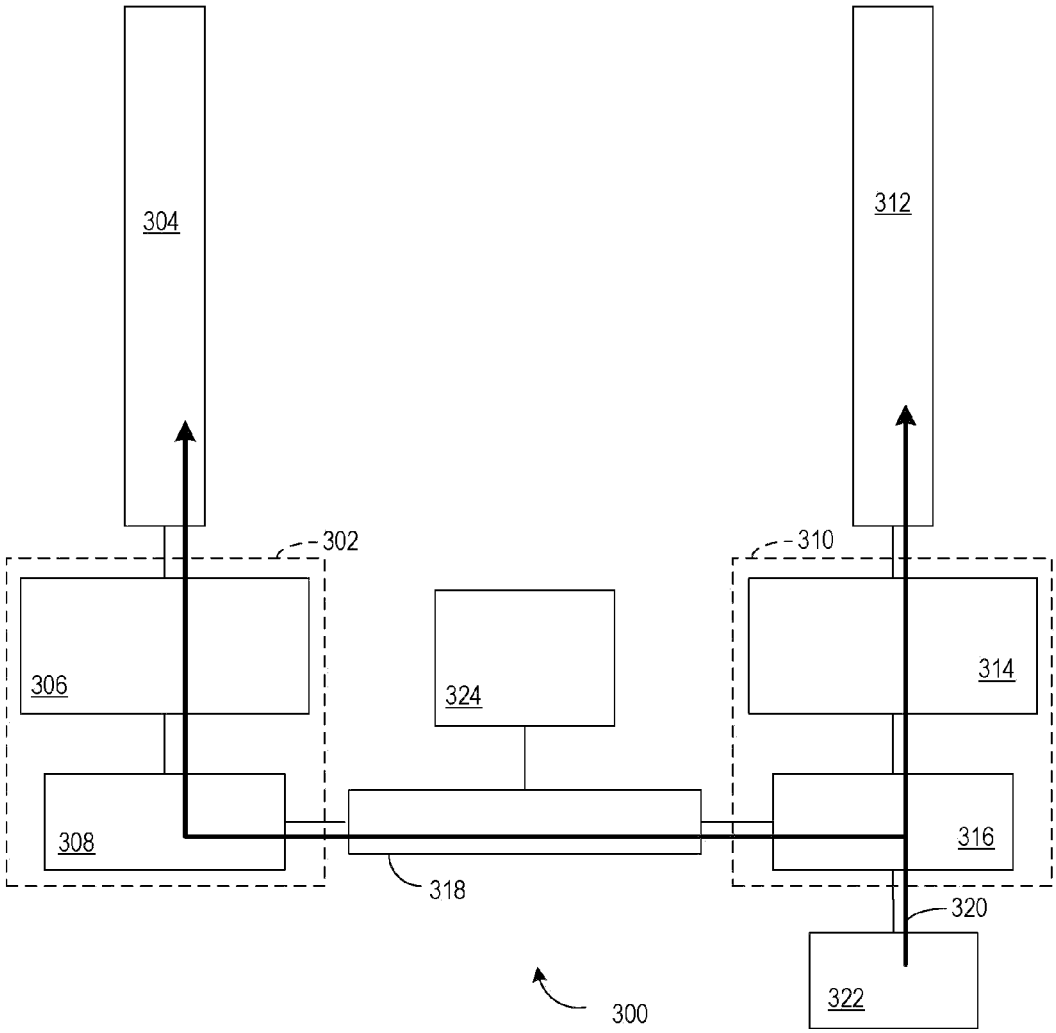
FIG. 3 shows a block diagram of another embodiment of a fuel pump drive system.

As described above, crank 222 may be coupled to first housing 208. It can be appreciated that such a crank may be coupled to one of the first housing and the second housing. Accordingly, FIG. 3 shows a block diagram of another embodiment of a fuel pump drive system, wherein a second housing is driven by a crank. As such, fuel pump drive system 300 includes a first variable cam timing device 302 coupled to a first camshaft 304, where the first variable cam timing device 302 has a first hydraulic actuator 306 and a first housing 308. Fuel pump drive system 300 further includes a second variable cam timing device 310 coupled to a second camshaft 312, where the second variable cam timing device 310 has a second hydraulic actuator 314 and a second housing 316. Fuel pump drive system 300 further includes a drive shaft 318 coupled between the first variable cam timing device 302 and the second variable cam timing device 310 upstream of the first hydraulic actuator 306 and the second hydraulic actuator 314. Fuel pump drive system 300 further includes a fuel pump 324, coupled to and driven by the drive shaft 318. As depicted by power flow 320, FIG. 3 illustrates an embodiment of a fuel pump drive system wherein the power flow is initiated at a crank 322 coupled to the second housing 316. Power may then be transferred from second housing 316 to the second camshaft 312 via the second hydraulic actuator 314. As such, power may also be transferred from second housing 316 to first housing 308 via drive shaft 318. Accordingly, first housing 308 may then transfer power to first camshaft 304 via first hydraulic actuator 306. In such an embodiment, by coupling drive shaft 318 between second housing 316 and first housing 308, the drive shaft is upstream of second hydraulic actuator 314 and first hydraulic actuator 306. Thus, not only does drive shaft 318 serve as a second timing chain, but also as a fuel pump drive without affecting the shifting velocity of the first and second hydraulic actuators.

Figure 4:
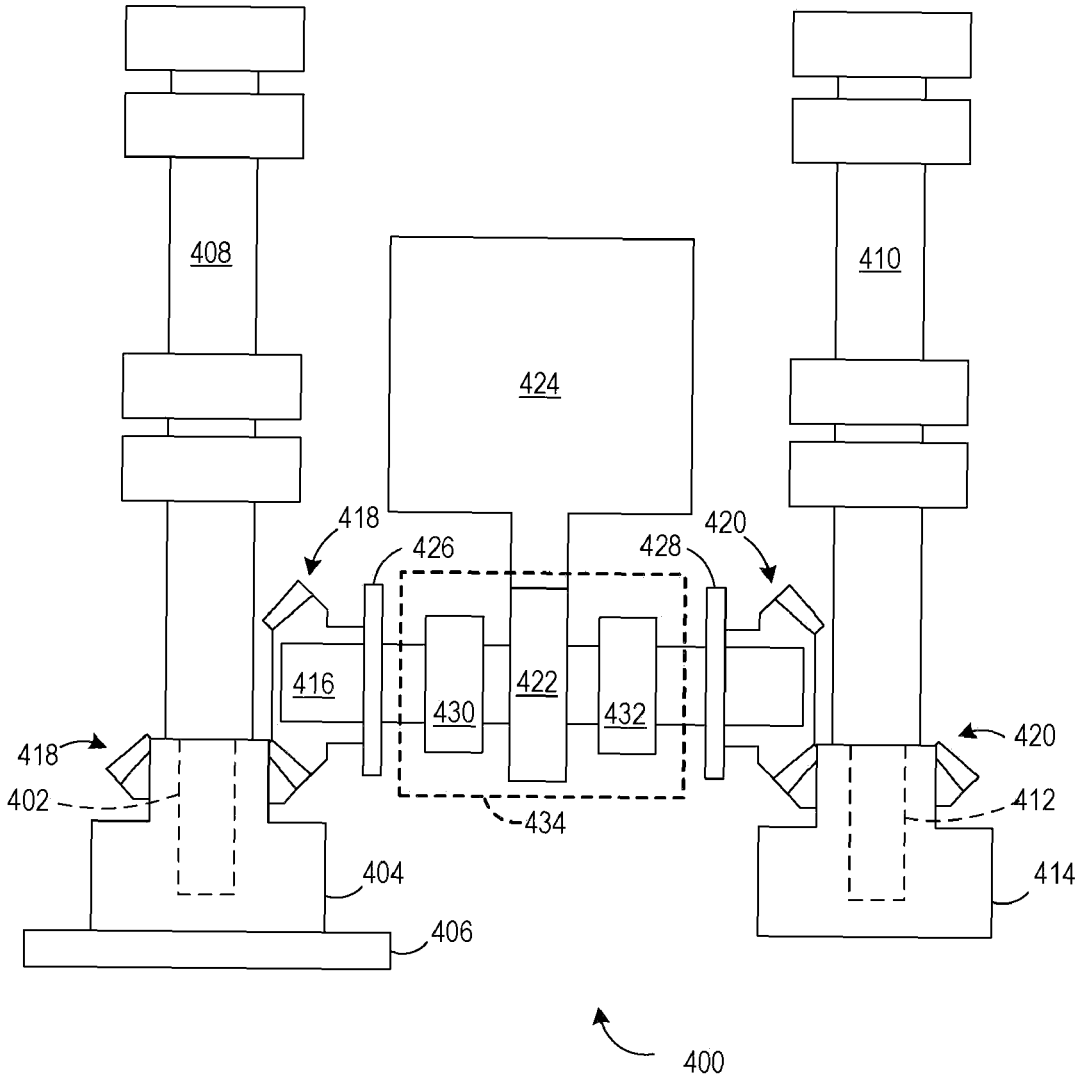
FIG. 4 shows a schematic depiction of an embodiment of a fuel pump drive system.

FIG. 4 shows a schematic depiction of an embodiment of a fuel pump drive system 400. Fuel pump drive system 400 may include a first variable cam timing device including a first hydraulic actuator 402 and a first housing 404. The first variable cam timing device may be, for example, of a variable vane type, such as a vane-type variable valve timing actuator wherein first housing 404 rotates with respect to first hydraulic actuator 402 via hydraulic fluid. Accordingly, first housing 404 is driven by a crank, wherein, for example, the primary timing chain drives a chain sprocket 406 coupled to the first housing 404. The first hydraulic actuator 402 is actuated by the hydraulic fluid within the first variable cam timing device to drive a first camshaft 408.

Similarly, a second camshaft 410 may be driven by a second hydraulic actuator 412, wherein second hydraulic actuator 412 is actuated by hydraulic fluid of a second variable cam timing device, such that second hydraulic actuator 412 is rotatable with respect to a second housing 414. The second housing 414 is coupled to the first housing via a drive shaft 416. In other words, power may be transferred from first housing 404 to second housing 414 via drive shaft 416, as described in more detail below. First camshaft 408 and second camshaft 410 may be of a same cylinder bank. For example, in one embodiment first camshaft 408 may be an exhaust camshaft and second camshaft 410 may be an intake camshaft. In an alternate embodiment, first camshaft 408 may be an intake camshaft and second camshaft 410 may be an exhaust camshaft.

Drive shaft 416 may be coupled to first housing 404 in any suitable manner. One such suitable coupling is a bevel gear 418, such that rotation of first housing 404 may be transferred via the bevel gear to induce rotation of drive shaft 416. In some embodiments, drive shaft 416 may be positioned at a right angle with respect to first camshaft 408 and second camshaft 410. In such embodiments, the two axes of bevel gear 418 may be at right angles with respect to one another as well. Likewise, a bevel gear 420 may be used to couple drive shaft 416 to second housing 414. As such, drive shaft 416 may serve as a second timing drive for coupling first housing 404 to second housing 414.

Drive shaft 416 may further include a fuel pump drive lobe 422 for driving a fuel pump 424. In some embodiments, fuel pump 424 may be a high pressure fuel pump. Thus, drive shaft 416 serves as a combined drive, in that it may replace a traditional configuration of a fuel pump drive on a cam, a secondary chain, a secondary tensioner, and secondary chain wear faces. Further, by driving the fuel pump upstream of where the valve timing is being phased, the shifting velocity is not affected, and therefore performance, emissions and fuel economy are not degraded.

Drive shaft 416 may further include thrust bearings and/or journal bearings to support drive shaft 416. Such bearings may be positioned in any suitable locations. In the depicted embodiment, a first thrust bearing 426 may be positioned on the drive shaft 416 between the first end of the drive shaft which is coupled to the first housing and the fuel pump drive lobe 422. Likewise, a second thrust bearing 428 may be positioned on the drive shaft 416 between the second end of the drive shaft which is coupled to the second housing and the fuel pump drive lobe 422. First thrust bearing 426 and second thrust bearing 428 may provide axial support to the drive shaft by constraining axial movement of the drive shaft.

As further shown, drive shaft 416 may include a first journal bearing 430 positioned on the drive shaft 416 between the first thrust bearing 426 and the fuel pump drive lobe 422. Likewise, a second journal bearing 432 positioned on the drive shaft 416 between the second thrust bearing 428 and the fuel pump drive lobe 422. First journal bearing 430 and second journal bearing 432 may provide rotor support to the drive shaft 416 by constraining radial movement of the drive shaft 416.

As such, rotating the drive shaft may include actuating first thrust bearing 426 and second thrust bearing 428. Accordingly, such rotation may further include actuating first journal bearing 430 and second journal bearing 432. In some embodiments, pump drive system 400 may further include a drive housing 434 surrounding a portion of drive shaft 416 and bolted to a cylinder head of the engine. Drive housing 434 may be of any suitable type. In the depicted embodiment, drive housing 434 partially surrounds fuel pump drive lobe 422, the first journal bearing 430 and the second journal bearing 432. In such an embodiment, drive housing 434 may be positioned on the drive shaft 416 between the first thrust bearing 426 and the second thrust bearing 428.

Figure 5:
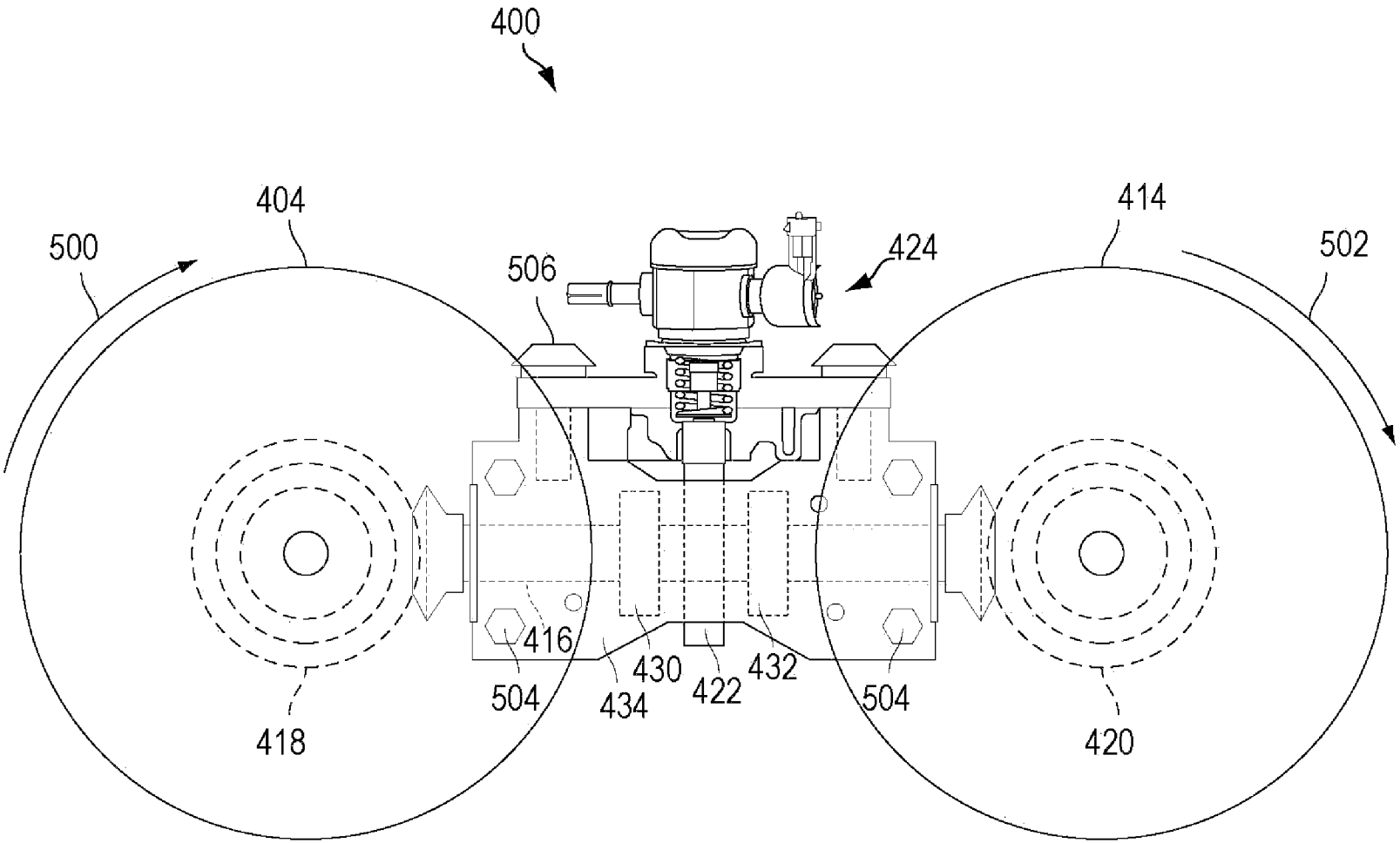
FIG. 5 shows a schematic depiction of a front view of the fuel pump drive system of FIG. 4.

FIG. 5 shows a schematic depiction of a front view of the fuel pump drive system 400 of FIG. 4. A first housing 404 may be driven by a chain sprocket with a primary timing chain, as indicated by an arrow at 500. Such rotation is then transferred from the first housing 404 to the drive shaft 416 via a bevel gear 418. The rotating drive shaft 416 then drives a second housing 414 via a second bevel gear 420, as indicated by an arrow at 502. Rotation of drive shaft 416 also drives a fuel pump 424 via a fuel pump drive lobe 422, as described hereafter with reference to FIG. 6. A drive housing 434 is bolted to a cylinder head via bolts 504 such that the drive housing 434 partially encloses the fuel pump drive lobe 422 and journal bearings 430 and 432. In some embodiments, drive housing 434 may be coupled to an assembly of the fuel pump as indicated by bolts 506.

Figure 6:
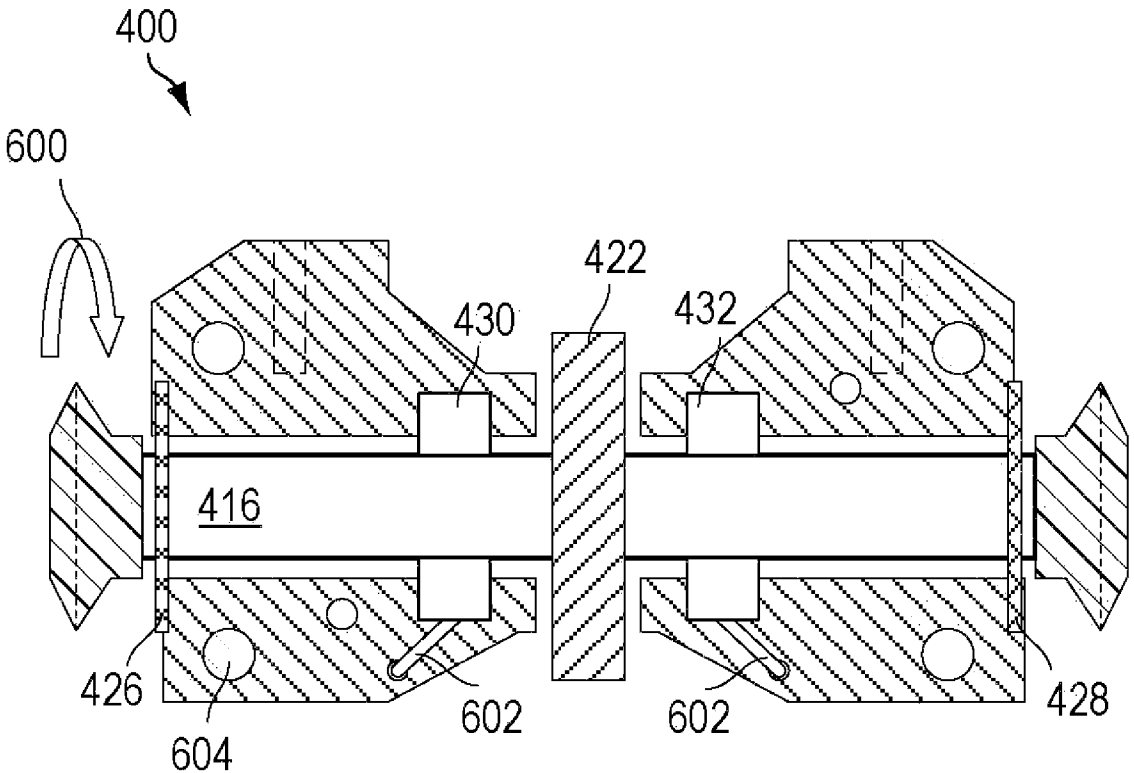
FIG. 6 shows another schematic depiction of a front view of the fuel pump drive system of FIG. 4.

FIG. 6 shows another schematic depiction of a front view of the fuel pump drive system 400 of FIG. 4 not including fuel pump 424. Here, a portion of drive housing 434 has been removed so as to illustrate drive shaft 416 and journal bearings 430 and 432. Upon rotation of drive shaft 416 as indicated by an arrow at 600, fuel pump drive lobe 422 actuates fuel pump 424 (shown in FIGS. 4 and 5). As further shown in FIG. 6, bearing oil feeds 602 may be used to lubricate journal bearings 430 and 432. Further, bolt hole 604 receives bolt 504 shown in FIG. 5.

Figure 7:
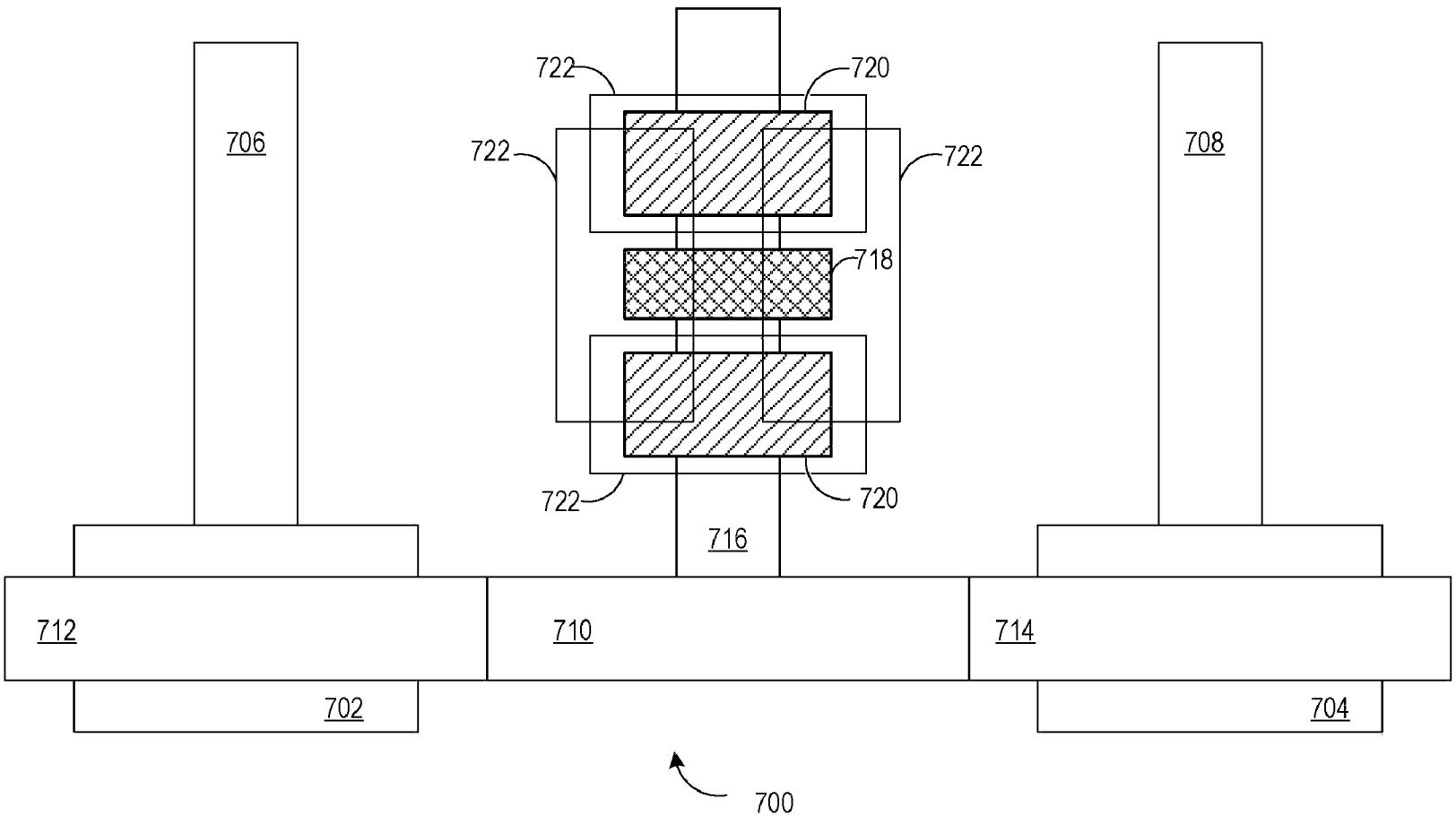
FIG. 7 shows a block diagram of another embodiment of a fuel pump drive system.

FIG. 7 shows a block diagram of another embodiment of a fuel pump drive system 700 which utilizes a series of gears. Fuel pump drive system 700 may include a first variable cam timing device 702 and a second variable cam timing device 704. Either one of the first variable cam timing device 702 or second variable cam timing device 704 may be driven by a crank. As an example, first variable cam timing device 702 may be driven by a crank, such that power may further be transferred from first variable cam timing device 702 to a first camshaft 706. First variable cam timing device 702 may be coupled to a pump shaft gear 710 via first cam gear 712, such that the coupling occurs upstream of actuation of first camshaft 706 with respect to the power flow. Pump shaft gear 710 may then drive second variable cam timing device 704 via a coupling such as second cam gear 714, where the coupling occurs upstream of actuation of second camshaft 708 with respect to the power flow. Pump shaft gear 710, first cam gear 712 and second cam gear 714 may be of any suitable gear type, such as spur gears, helical gears, etc.

Although the above configuration is described in the context of an example where the first variable cam timing device 702 is being driven by the crank, it can be appreciated that the second variable cam timing device 704 may instead be driven by the crank.

Rotation of pump shaft gear 710 actuates a pump shaft 716 which then actuates a pump. As an example, pump shaft 716 may be coupled to a pump drive cam 718, such that rotation of pump shaft 716 causes pump drive cam 718 to actuate the pump. Further, in some embodiments, bearing journals such as bearing journals 720 may be used to provide rotor support to pump shaft 716 by constraining radial movement of pump shaft 716. Housings such as pump shaft housing 722 may be used to variously enclose portions of pump shaft 716, pump drive cam 718 and/or bearing journals 720. It will be appreciated that the configurations disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application.

Such claims, whether broader, narrower, equal, or different in scope to the original claims, also are regarded as included within the subject matter of the present disclosure.

The invention claimed is:

1. A system for an engine driven by an engine crankshaft, comprising:

a first variable cam device including a first hydraulic actuator;

a second variable cam device including a second hydraulic actuator;

an intermediate power transfer mechanism coupled between the first variable cam device and the second variable cam device upstream, in a direction of power flow from the engine crankshaft, of the first hydraulic actuator and the second hydraulic actuator; and an auxiliary device coupled to and driven by the intermediate power transfer mechanism.

2. The system of claim 1, wherein the first variable cam device is a first variable cam timing device and wherein the second variable cam device is a second variable cam timing device, and wherein the auxiliary device is a fuel pump, and wherein the intermediate power transfer mechanism is a drive shaft.

3. The system of claim 2, wherein the fuel pump is coupled to a direct injector of a cylinder of the engine.

4. The system of claim 2, wherein the first variable cam device is coupled to a first camshaft and wherein the second variable cam device is coupled to a second camshaft.

5. The system of claim 4, wherein the first variable cam device further includes a first housing rotatable relative to the first hydraulic actuator via hydraulic fluid, a first end of the drive shaft being coupled to the first housing upstream of the first hydraulic actuator, and wherein the second variable cam device further includes a second housing rotatable relative to the second hydraulic actuator via hydraulic fluid, a second end of the drive shaft being coupled to the second housing upstream of the second hydraulic actuator.

6. The system of claim 5, wherein the first camshaft and the second camshaft are positioned parallel to one another, and the drive shaft is positioned between the first housing and the second housing at a right angle with respect to the first camshaft and the second camshaft.

7. The system of claim 6, wherein the first camshaft is an exhaust camshaft and the second camshaft is an intake camshaft.

8. The system of claim 5, wherein the first housing is coupled to the first end of the drive shaft via a first bevel gear and the second housing is coupled to the second end of the drive shaft via a second bevel gear.

9. The system of claim 5, wherein one of the first housing and the second housing is driven by a primary timing chain via a chain sprocket, and wherein the primary timing chain is further driven by the engine crankshaft.

10. The system of claim 4, wherein the drive shaft further includes a fuel pump drive lobe to actuate the fuel pump, and wherein a first thrust bearing is positioned on the drive shaft between the first end of the drive shaft and the fuel pump drive lobe, and a second thrust bearing is positioned on the drive shaft between the second end of the drive shaft and the fuel pump drive lobe, the first thrust bearing and the second thrust bearing providing axial support to the drive shaft by constraining axial movement of the drive shaft.

11. The system of claim 10, further comprising a first journal bearing positioned on the drive shaft between the first thrust bearing and the fuel pump drive lobe, and a second journal bearing positioned on the drive shaft between the second thrust bearing and the fuel pump drive lobe, the first journal bearing and the second journal bearing providing rotor support to the drive shaft by constraining radial movement of the drive shaft.

12. The system of claim 11, further comprising a drive housing partially surrounding the fuel pump drive lobe, the first journal bearing and the second journal bearing, the drive housing being positioned on the drive shaft between the first thrust bearing and the second thrust bearing, and the drive housing being bolted to a cylinder head of the engine.

13. The system of claim 4, wherein the first camshaft and the second camshaft are of a same bank.

14. The system of claim 1, wherein the engine is a dual overhead cam engine.

15. The system of claim 1, wherein the first hydraulic actuator and the second hydraulic actuator are each of a variable vane type.

16. The system of claim 1, wherein the intermediate power transfer mechanism is a gear.

17. A method of operating a high pressure fuel pump of an engine, the method comprising:

driving a chain sprocket with a primary timing chain;

rotating a first housing of a first variable cam timing device and a first bevel gear with the chain sprocket, the first variable cam timing device including a first hydraulic actuator coupled to a first camshaft;

rotating a drive shaft coupled to the first housing via the first bevel gear, the drive shaft further coupled to a second housing of a second variable cam timing device via a second bevel gear, the second variable cam timing device including a second hydraulic actuator coupled to a second camshaft; and driving the high pressure fuel pump via a fuel pump drive lobe, the fuel pump drive lobe coupled to the drive shaft.

18. The method of claim 17, wherein rotating the drive shaft is upstream in a direction of power flow from an engine crankshaft, the method further comprising rotating the first camshaft via the first hydraulic actuator, the first hydraulic actuator rotating with respect to the first housing via hydraulic fluid, and further comprising rotating the second camshaft via the second hydraulic actuator, the second hydraulic actuator rotating with respect to the second housing via hydraulic fluid.

19. The method of claim 18, wherein driving the chain sprocket with the primary timing chain initiates the power flow from the engine crankshaft, such that power is transferred from the first housing to the first camshaft via the first hydraulic actuator, and such that power is transferred from the first housing to the second housing via the drive shaft, the second housing transferring power to the second camshaft via the second hydraulic actuator.

20. The method of claim 18, wherein one of the first camshaft and the second camshaft is an exhaust camshaft and wherein the other one of the first camshaft and the second camshaft is an intake camshaft.

21. A fuel pump drive system for a dual overhead cam engine driven by an engine crankshaft, the fuel pump drive system comprising:

a first variable cam timing device coupled to a first camshaft, the first variable cam timing device having a first hydraulic actuator and a first housing rotatable relative to the first hydraulic actuator via hydraulic fluid;

a second variable cam timing device coupled to a second camshaft, the second variable cam timing device having a second hydraulic actuator and a second housing rotatable relative to the second hydraulic actuator via hydraulic fluid, the second camshaft being parallel to the first camshaft, and the second camshaft being of a same bank as the first camshaft;

a drive shaft having a first end coupled to the first housing upstream of the first hydraulic actuator and a second end coupled to the second housing upstream of the second hydraulic actuator, wherein upstream is in terms of a direction of power flow from the engine crankshaft, the drive shaft further including one or more thrust bearings and one or more journal bearings, and the drive shaft being at a right angle with respect to the first camshaft and the second camshaft; and a fuel pump, coupled to the drive shaft and driven by a fuel pump drive lobe coupled to the drive shaft.

* * * * *